US009576462B2

(12) United States Patent
DeAngelo

(10) Patent No.: US 9,576,462 B2
(45) Date of Patent: Feb. 21, 2017

(54) GPS DEVICE FOR LOCATING A LOST CHILD

(71) Applicant: Steven DeAngelo, Everett, MA (US)

(72) Inventor: Steven DeAngelo, Everett, MA (US)

( * ) Notice: Subject to any disclaimer, the term of this patent is extended or adjusted under 35 U.S.C. 154(b) by 0 days.

(21) Appl. No.: 14/834,976

(22) Filed: Aug. 25, 2015

(65) Prior Publication Data

US 2016/0055731 A1 Feb. 25, 2016

Related U.S. Application Data

(60) Provisional application No. 62/041,160, filed on Aug. 25, 2014.

(51) Int. Cl.
*G08B 1/08* (2006.01)
*G08B 21/02* (2006.01)

(52) U.S. Cl.
CPC ..... *G08B 21/0269* (2013.01)

(58) Field of Classification Search
CPC ..... G08B 21/0269; G08B 25/10; G08B 1/03
USPC ..... 340/539.13, 573.1, 573.4, 539.15, 691.6,340/8.1; 455/404.2
See application file for complete search history.

(56) References Cited

U.S. PATENT DOCUMENTS

| | | | | |
|---|---|---|---|---|
| 6,278,370 | B1 | 8/2001 | Underwood | |
| 7,394,364 | B2 * | 7/2008 | Elliott | G08B 13/1427 340/539.1 |
| 8,121,620 | B2 | 2/2012 | Kim | |
| 8,412,226 | B2 | 4/2013 | Ron | |
| 8,508,361 | B2 * | 8/2013 | Paolini | G01S 5/0027 340/539.13 |
| 9,361,783 | B2 * | 6/2016 | Harvey | G08B 25/016 |
| 9,392,404 | B2 * | 7/2016 | Daoura | H04W 4/02 |
| 2007/0247307 | A1 | 10/2007 | Riep | |
| 2009/0197612 | A1 | 8/2009 | Kiiskinen | |
| 2012/0050048 | A1 | 3/2012 | Sandra | |

* cited by examiner

*Primary Examiner* — Toan N Pham
(74) *Attorney, Agent, or Firm* — The Gray Law Group, LTD; Robert W. Gray

(57) ABSTRACT

A pendant which provides a large, prominent alert button comprises a GPS device for locating a lost child. The child user may wear the pendant and may press the alert button to alert authorities, family, and friends. The pendant then sends a location query to GPS, obtains the child user's GPS coordinates, and transmits the GPS coordinates within a distress message. This distress message may be received by authorities, by the child user's parent, or other responsible parties via a mobile application which may be installed on a smartphone or other mobile electronic device. The pendant may also be activated by the parent via the mobile application. In alternate embodiments, a microchip GPS can be inserted just under the skin, or a contact lens tracking device. The device can also aid in the search for people lost in avalanches, earthquakes, and those lost at sea.

10 Claims, 2 Drawing Sheets

GPS DEVICE FOR LOCATING A LOST CHILD

CROSS-REFERENCE TO RELATED APPLICATIONS

This Application claims the benefit of U.S. Provisional Application No. 62/041,160, filed Aug. 25, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to Global Positioning System (GPS) devices and in particular to a GPS device for locating a lost child. A child becoming lost or abducted is every parent's worst fear. Various tracking devices have been developed, but each has been unsatisfactory in its own way. A device that enables Global Positioning System (GPS) tracking which may be easily worn as a pendant, a contact, or inserted under the skin of the child, will enable the user to discreetly track a child who is at risk of becoming lost. A GPS device for locating a lost child, which may be used by a parent or other caretaker to cause a location query from a pendant in a lost child's possession, and then acquires that location information, would resolve this problem.

SUMMARY OF THE INVENTION

Accordingly, the invention is directed to a GPS device for locating a lost child. The tracking device is comprised of a pendant which provides a large, prominent alert button. The child user may wear the pendant and may press the alert button to alert authorities, family, and friends when in danger. The pendant then sends a location query to GPS, obtains the child user's GPS coordinates, and transmits the GPS coordinates within a distress message. This distress message may be received by authorities, by the child user's parent, or other responsible parties via a mobile application which may be installed on a smartphone or other mobile electronic device. The pendant may also be activated by the parent via the mobile application. In alternate embodiments, a microchip GPS can be inserted just under the skin, or a contact lens tracking device can be worn by older children. The device can also aid in the search for people lost in avalanches, earthquakes, and those lost at sea.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
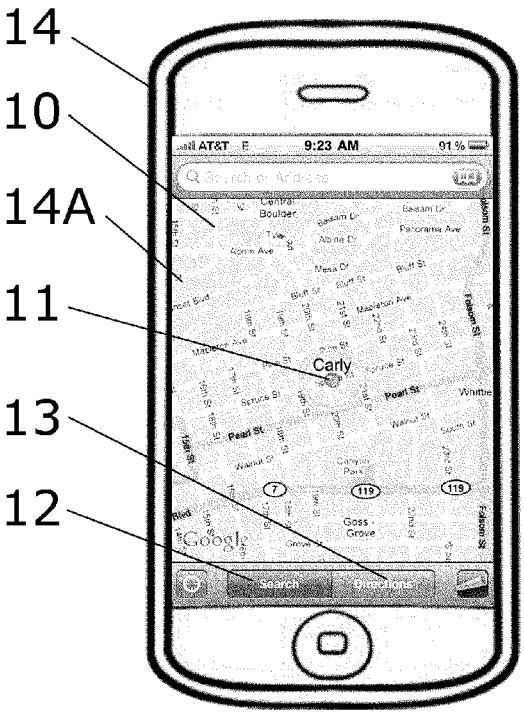
FIG. 1 is a front view of a mobile electronic device with the mobile application of the first exemplary embodiment installed, displaying the street display 10, the lost subject icon 11, the search button 12, the directions button 13, the mobile electronic device 14, and the visual display 14A.
Figure 2:
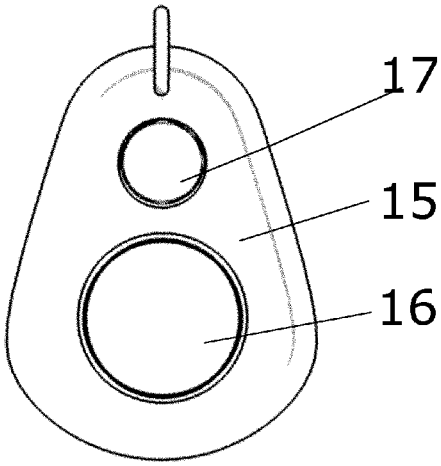
FIG. 2 is a front view of the pendant component of the first exemplary embodiment, displaying the pendant 15, the alert button 16, and the reset button 17.
Figure 3:
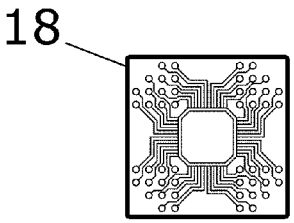
FIG. 3 is a front view of the microchip component of the second exemplary embodiment, displaying the microchip 18.
Figure 4:
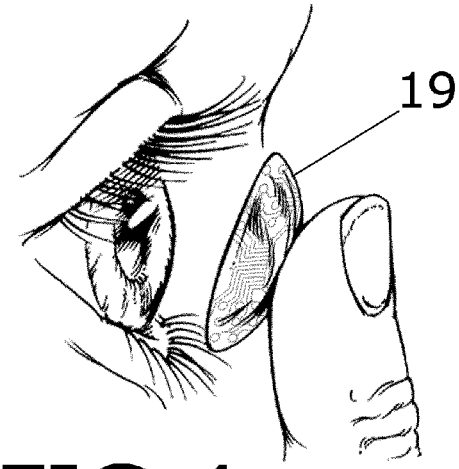
FIG. 4 is a side perspective view of the contact lens component of the third exemplary embodiment being placed in a child user's eye, displaying the contact lens 19.
Figure 5:
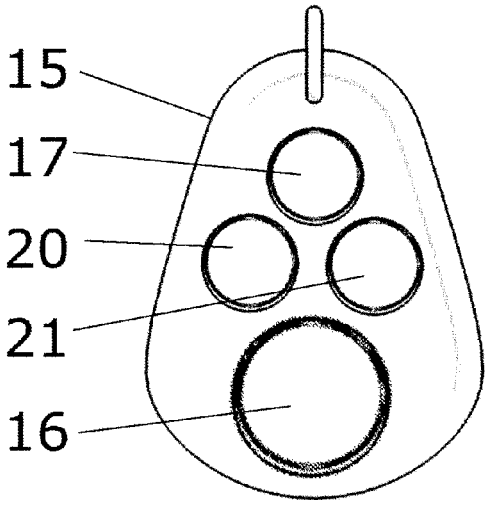
FIG. 5 is a front view of the pendant component of the pendant component displaying the pendant 15, the alert button 16, the reset button 17, the camera 20, and the microphone 21.

Referring now to the invention in more detail, the invention is directed to a GPS device for locating a lost child.

It is to be understood that while the invention is intended for use with a child who may become lost or be abducted, this is not intended as a limitation. With or without modifications, the invention may be used with any person who is at risk of becoming lost or abducted, any pet that is at risk of becoming lost or abducted, or any object at risk of becoming lost or stolen.

The first exemplary embodiment is comprised of a mobile application which may be installed in the smartphone or other mobile electronic device 14 of a parent or other responsible adult user, and a battery-powered pendant 15 which may be worn by a child user who is at risk of becoming lost. Preferably, the size of the pendant 15 is such that when concealed, its presence is not obvious to the child user or other observers. But, the pendant may come in any shape or size.

The pendant 15 provides a large, prominent, brightly colored alert button 16 and a smaller reset button 17 on its front surface. If the pendant 15 is worn visibly, the child user may press the alert button 16 to alert authorities, family, and friends when in danger. The pendant 15 then transmits a location query to GPS, obtains the child user's GPS coordinates, and transmits the GPS coordinates within or appended to the end of a recorded distress message. This distress message may be received by authorities, by the child user's parent, or other responsible adult user via the mobile application. The procedure is repeated at pre-determined intervals, such as once every 60 seconds, obtaining and transmitting new GPS coordinates in the event that the lost or abducted child user is not remaining stationary.

To use the first exemplary embodiment, the adult user installs the mobile application on a mobile electronic device 14, the pendant 15 to be worn openly by the child user. The mobile application provides a street display 10 on the visual display 14A of the mobile electronic device 14.

If the child user becomes lost or is in a dangerous situation, the child user may press the alert button 16. When the pendant 15 is activated and the child user's GPS coordinates are received, a lost subject icon 11 appears on the street display 10, indicating the location of the lost child. The pendant 15 may also be activated by the adult user via the mobile application in the event that the child user becomes missing, by clicking on the search button 12 on the lower left corner of the visual display 14A. Additionally, the activation of the pendant 15 may activate a camera 20 and/or microphone 21 on the pendant.

The adult user may also click on the directions button 13 on the lower right corner of the visual display 14A, to obtain directions to the location of the lost child. The mobile application then transmits a query to a navigational website such as Mapquest.com™ to obtain directions, which are then provided on the visual display 14A. When the child user has been recovered, the reset button 17 may be pressed to deactivate the pendant 10.

In the second exemplary embodiment, the pendant 15 is replaced by just a microchip 18 with an internal battery, which may be surgically implanted just under the skin of the child user. Alternately, the chip may be installed under the skin of an animal or within the frame of any device.

In the third exemplary embodiment, the pendant 15 is replaced by a contact lens 19 which may be worn by older children, and contains optically transparent microchip circuitry. The circuitry may alternatively be arranged around the outside edge of the contact lens in order to provide a clear viewing area. The contact lens 19 employs existing technology and harvests electric power from nearby sources of radio transmissions.

To use the second and third exemplary embodiments, the adult user must use the mobile application to activate the microchip 18 or the contact lens 19. The second and third exemplary embodiments do not provide an alert button 16 or a reset button 17 and, due to limited transmission power, the effective range of the GPS coordinates transmissions is significantly reduced.

Preferably, for the second and third exemplary embodiments, GPS queries are not automatically sent by the microchip 18 or the contact lens 19, but in response to periodic queries from the mobile application. For all embodiments, the activation signal and queries from the mobile application, as well as transmissions of GPS coordinates, are preferably encrypted as a safety measure.

Electronic components of the pendant 15, the microchip 18, and the contact lens 19 preferably include a transmitter, a signal tracker, an internal loop antenna with a preamplifier, a microprocessor, a memory device, a reference oscillator and, in the pendant 15 and the microchip 18, a replaceable battery.

The pendant 15 and the microchip 18 are preferably manufactured from rigid, durable materials such as steel, aluminum alloy, brass, copper alloy, and plastic. The contact lens 19 is preferably manufactured from a semi-rigid, durable material which is transparent and conducts electricity, such as acrylic polymer.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A GPS device for locating a lost child, comprising:
(a) a microchip having an internal battery;
(b) said microchip being configured to transmit a location query to a global positioning system and receiving coordinates;
(c) said microchip being configured to transmit a distress message;
(d) said distress message containing said location query;
(e) said microchip transmitting said distress message to a mobile application or police scanners at predetermined intervals;
(f) said mobile application being installed on a mobile electronic device having a visual display;
(g) said mobile application being configured to receive said distress message;
(h) said mobile application being further configured to provide a street display, a search button, and a directions button on said visual display;
(i) said mobile application being further configured to provide a subject icon on said street display showing the coordinates of said location query;
(j) said search button being configured to activate said microchip and receive said coordinates of location query; and
(k) said directions button being configured to provide directions from a user's current location to said subject icon.

2. The GPS device for locating a lost child of claim 1, further comprising a pendant; said pendant having an alert button and a reset button; said alert button being configured to activate said location query and said distress message; said reset button being configured to deactivate said location query and said distress message.

3. The GPS device for locating a lost child of claim 2, wherein said pendant further comprises a camera and microphone; said camera and microphone being configured to capture video and audio when said alert button is activated.

4. The GPS device for locating a lost child of claim 1, wherein said directions are retrieved by said application from a navigational website.

5. The GPS device for locating a lost child of claim 1, wherein said microchip is implanted below a skin of a user.

6. The GPS device for locating a lost child of claim 5, wherein said user is one of either an adult, a child, or an animal.

7. The GPS device for locating a lost child of claim 1, wherein said microchip is attached to a device.

8. The GPS device for locating a lost child of claim 1, wherein said microchip is installed within a contact lens.

9. The GPS device for locating a lost child of claim 8, wherein said contact lens incorporates optically transparent microchip circuitry.

10. The GPS device for locating a lost child of claim 8, wherein said microchip, having microchip circuitry, is incorporated around a border of said contact lens.

* * * * *